US009633808B2

(12) United States Patent
Ricciuti et al.

(10) Patent No.: US 9,633,808 B2
(45) Date of Patent: Apr. 25, 2017

(54) ELECTRICAL INTERRUPTION APPARATUS WITH WEAR INDICATOR

(71) Applicant: EATON CORPORATION, Cleveland, OH (US)

(72) Inventors: Anthony Thomas Ricciuti, Bethel Park, PA (US); Thomas Kenneth Fogle, Pittsburgh, PA (US); Daniel Evan Palmieri, Coraopolis, PA (US)

(73) Assignee: EATON CORPORATION, Cleveland, OH (US)

( * ) Notice: Subject to any disclaimer, the term of this patent is extended or adjusted under 35 U.S.C. 154(b) by 271 days.

(21) Appl. No.: 14/506,748

(22) Filed: Oct. 6, 2014

(65) Prior Publication Data

US 2016/0099118 A1 Apr. 7, 2016

(51) Int. Cl.
*H01H 33/666* (2006.01)
*H01H 1/00* (2006.01)

(52) U.S. Cl.
CPC ..... *H01H 33/666* (2013.01); *H01H 1/0015* (2013.01); *H01H 2033/6667* (2013.01)

(58) Field of Classification Search
CPC ..... H01H 1/0015; H01H 2033/6667; H01H 33/666
See application file for complete search history.

(56) References Cited

U.S. PATENT DOCUMENTS 4,181,922 A * 1/1980 Matsko ..... H01H 71/74 335/172
4,504,808 A * 3/1985 Basnett ..... H01H 33/666 335/132
5,095,293 A * 3/1992 Patel ..... H01H 1/0015 335/17
5,206,616 A * 4/1993 Stegmuller ..... H01H 33/666 218/136
5,436,414 A * 7/1995 Hodkin ..... H01H 33/666 200/17 R
6,002,560 A * 12/1999 Nguyen ..... H01H 1/0015 361/115
6,150,625 A * 11/2000 Marchand ..... H01H 1/0015 218/118
6,331,687 B1 * 12/2001 Dunk ..... H01H 11/0062 218/140
6,921,989 B2 * 7/2005 Baranowski ..... H01H 11/0062 218/154
7,075,027 B1 * 7/2006 Fogle ..... H01H 33/666 218/140
7,239,490 B2 * 7/2007 Benke ..... H01H 33/666 218/118

* cited by examiner

*Primary Examiner* — Truc Nguyen
(74) *Attorney, Agent, or Firm* — Eckert Seamans; Brij Agarwal; Grant Coffield

(57) ABSTRACT

An improved electrical interruption apparatus provides an improved wear indicator that is configured to depict an amount of wear that has been experienced by a set of separable contacts of a vacuum interrupter. At an easily visible location on a drive rod of the circuit interruption apparatus, the wear indicator indicates the extent to which the set of contacts have degraded. The wear indicator is attached to a spring-loaded over-travel mechanism that engages together the set of electrical contacts.

11 Claims, 4 Drawing Sheets

ELECTRICAL INTERRUPTION APPARATUS WITH WEAR INDICATOR

BACKGROUND

Field

The disclosed and claimed concept relates generally to electrical distribution equipment and, more particularly, to an electrical interruption apparatus that includes a wear indicator.

Related Art

Electrical distribution equipment is well known and includes many components such as electrical switchgear that may contain therein electrical interruption devices such as circuit breakers, vacuum interrupters, and the like without limitation. Such electrical interruption devices typically include a set of separable contacts which, when separated, desirably open a protected portion of a circuit. It is understood, however, that electrical arcing between the contacts can result in vaporization of the material of the contacts and resultant wear of the contacts. Since such electrical interruption devices typically include a mechanism that is spring loaded and that applies a compressive force to maintain the contacts in their closed position, a loss of the material of the contacts due to wear can require the contacts to move a relatively greater distance in order to become electrically engaged with one another. A consequence of having to move the contacts a greater distance is that the spring-loaded mechanism will apply a reduced compressive force to the worn contacts. This is because a compression spring of the spring-loaded mechanism is relatively less compressed as a result of the increased distance. Such reduced compressive force is undesirable, and it is therefore known to provide wear indicators on certain electrical interruption devices. While such indicators have been generally effective for their intended purposes, they have not been without limitation.

In some applications, such as those involving vacuum interrupters for example, the wear indicator can be difficult or impossible to accurately assess since is may be situated at a visually inaccessible location within a switchgear cabinet or may be otherwise unreachable for routine examination. It thus would be desirable to provide a solution that overcomes these and other shortcomings known in the relevant art.

SUMMARY

An improved electrical interruption apparatus provides an improved wear indicator that is configured to depict an amount of wear that has been experienced by a set of separable contacts of a vacuum interrupter. At an easily visible location on a drive rod of the circuit interruption apparatus, the wear indicator indicates the extent to which the set of contacts have degraded. The wear indicator is attached to a spring-loaded over-travel mechanism that engages together the set of electrical contacts.

Accordingly, an aspect of the disclosed and claimed concept is to provide an improved electrical interruption apparatus having a wear indicator that can be easily observed and that indicates a state of wear of a pair of contacts of a vacuum interrupter or other circuit interruption device.

Accordingly, an aspect of the disclosed and claimed concept is provided by an improved electrical interruption apparatus, the general nature of which can be stated as including a set of separable contacts comprising a stationary contact and a movable contact, a drive rod comprising an indicator and being movable between an OPEN position wherein the stationary and movable contacts are separated from one another and a CLOSED position wherein the stationary and movable contacts are engaged with one another, a biasing apparatus, and an indication apparatus, the biasing apparatus having a driven portion that is connected with the drive rod and further having a responsive portion that is connected with the movable contact, the biasing apparatus being movable between a first state when the drive rod is in the OPEN position and a second state wherein the drive rod is in the CLOSED position and the movable contact is biased by the biasing apparatus against the stationary contact, at least one of the driven portion and the responsive portion being movable a relative distance with respect to the other of the driven portion and the responsive portion in moving between the first and second states, and the indication apparatus comprising an indication element that is connected with the responsive end and that is structured to provide an indication that is representative of the relative distance, the indication being a relative position of the indication element with respect to the indicator.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

Figure 1:
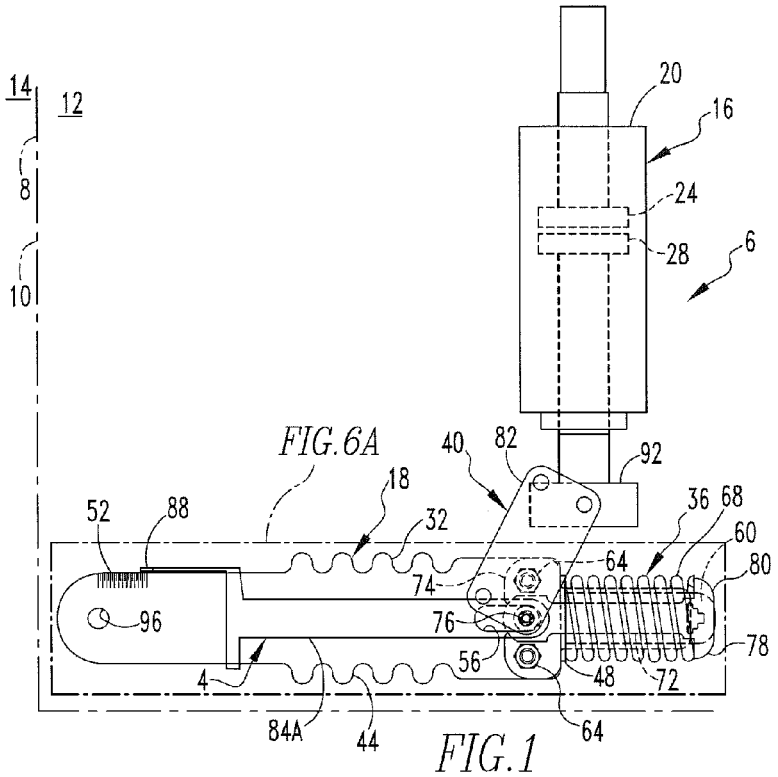
FIG. 1 is a side elevational view of an improved electrical interruption apparatus in accordance with the disclosed and claimed concept having a drive rod and a set of separable contacts in an OPEN position.

An improved wear indicator 4 is depicted in FIGS. 1-6C as being a part of an improved circuit interruption apparatus 6 that is in accordance with the disclosed and claimed concept. The wear indicator 4 can be said to function as an indication apparatus that is configured to output an indication of the wear of a set of separable contacts of the circuit interruption apparatus 6, as will be set forth in greater detail below. The circuit interruption apparatus 6 is depicted in FIG. 1 as being situated within a schematically-depicted switchgear cabinet 8 having an access wall 10 that is removable and from where the circuit interruption apparatus 6 and its wear indicator can be observed. An interior of the switchgear cabinet 8 is indicated generally at the numeral 12, and an exterior of the switchgear cabinet 8 is depicted generally at the numeral 14, with both being situated on opposite sides of the wall 10.

The circuit interrupter apparatus 6 can be described as including the a vacuum interrupter 16 and as further including a drive mechanism 18 that includes the wear indicator 4. The vacuum interrupter 16 is a conventional type of vacuum interrupter having an evacuated vacuum bottle 20 within which a fixed contact 24 and a movable contact 28 are disposed. The fixed and movable contacts 24 and 28 are movable between an OPEN position spaced apart as is depicted generally in FIG. 1 and a CLOSED position electrically connected together as is depicted generally in FIGS. 4 and 5. The fixed and movable contacts 24 and 28 in the CLOSED condition complete a protected portion of an electrical circuit in a known fashion. The evacuated region within the interior of the vacuum bottle 20 facilitates the rapid extinction of electrical arcs between the fixed and movable contacts 24 and 28 when they are in close proximity to one another.

The drive mechanism 18 can be said to include a drive rod 32, an over-travel mechanism 36, and a bellcrank 40 that are cooperable together to move the fixed and movable contacts 24 and 28 between the OPEN and CLOSED positions. The drive rod 32 includes an elongated shank 44 having a set of graduations 52 that are situated generally at one end of the shank 44. A flange 48 is situated generally at the other end of the shank 44. In the depicted exemplary embodiment, the graduations 52 are a set of markings that are marked on the shank 44 of the drive rod 32 and that serve as indicators of wear of the contacts 24 and 28. In other embodiments the graduations 52 could be stamped markings or virtually any other type of indicia which, when used in cooperation with the wear indicator 4, provide an indication of a degree of wear of the fixed and movable contacts 24 and 28. The shank 44 has an elongated slot 56 formed therein whose use will be described in greater detail below. The drive rod 32 can be said to be in an OPEN position when the contacts 24 and 28 are in their OPEN position, and the drive rod 32 can further be said to be in a CLOSED position when the contacts 24 and 28 are in their CLOSED position.

The over-travel mechanism 36 is a spring-loaded biasing apparatus that applies a compressive force to the movable contact 28 to bias it into engagement and electrical contact with the fixed contact 24. The over-travel mechanism 36 can be said to include a support 60 that is attached to the shank 44 with a pair of nuts 64 or other fasteners, a compression spring 68, a follower rod 72 that is cooperable with the compression spring 68, and a pin 76 that is movably received in the slot 56. The support 60 can be said to movably support thereon the compression spring 68 and the follower rod 72. The follower rod 72 extends through the central axial region of the compression spring 68 and includes a flared retainer 80 that engages the compression spring 68 and that retains the compression spring 68 interposed between the retainer 80 and the flange 48. The pin 76 is mounted on the follower rod 72 opposite the retainer 80 and, as suggested above, is movably received in the slot 56.

The pin 76 and the retainer 80 are situated generally at opposite ends of the follower rod 72, and the reception of the pin 76 against the rightmost (from the perspective of FIGS. 1-2 and 4-6A) end of the slot 56 constrains the compression spring 68 between the retainer 80 and the flange 48 with a certain minimal level of spring preload.

The over-travel mechanism 36 can be said to be movable between a first state when the drive rod 32 is in its OPEN position and a second state when the drive rod 32 is in its CLOSED position. The over-travel mechanism 36 can additionally be said to include a driven portion 74 that is connected with the drive rod 32 and a responsive portion 78 that is connected with the bellcrank 40. The driven portion 74 can be said to include the flange 48 and the support 60, which are understood to move with the drive rod 32. The responsive portion 78 can be said to include the follower rod 72 and the pin 76, which are operatively situated at the opposite end of the compression spring 68 from the flange 48. As will be understood from the teachings presented herein, the responsive portion 78 is movable with respect to the driven portion 74 upon compression of the compression spring 68.

Figure 3:
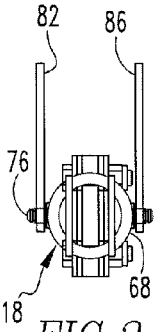
FIG. 3 is an end elevational view of the electrical interruption apparatus of FIG. 1.
Figure 2:
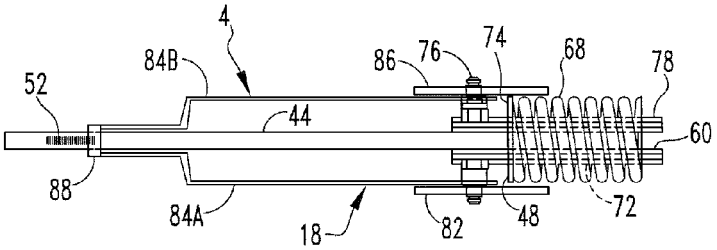
FIG. 2 is a top plan view of the electrical interruption apparatus of FIG. 1.

As can be understood from FIGS. 1-3, the bellcrank 40 includes a first plate 82 and a second plate 86 that are each connected with opposite ends of the pin 76 and extend between the pin 76 and a lug 92 of the movable contact 28. Motion of the drive rod 32 along the longitudinal extent of the shank 44 applies a compressive force to the compression spring 68 which, in turn, applies a load to the retainer 80 which transfers the load through the follower rod 72 to the pin 76 and thus to the bellcrank 40.

When the drive mechanism 18 is in the position depicted generally in FIG. 1 wherein the fixed and movable contacts 24 and 28 are in the OPEN position, the drive rod 32 can be said to be in a first location with respect to the vacuum interrupter 16, which is the OPEN position of the drive rod 32. However, when the drive rod 32 is moved in a rightward direction (from the perspective of FIGS. 1-2 and 4-6A) to its CLOSED position, such as through the use of a structure received in a hole 96 that is formed in an end of the shank 44, the above-mentioned transfer of forces and motion causes the bellcrank 40 to move the fixed and movable contacts 24 and 28 from their OPEN position depicted generally in FIG. 1 to their CLOSED position as is depicted generally in FIGS. 4 and 5. Such movement of the drive rod 32 in the rightward direction initially causes the flange 48 to translate the compression spring 68 to the point at which the bellcrank 40 has caused the movable contact 28 to physically and electrically engage the fixed contact 24. Further movement of the drive rod 32 to its closed position compresses the compression spring 68 since the retainer 80 is fixed in position upon engagement of the movable contact 28 with the fixed contact 24. In comparing FIGS. 1 and 4, it can be seen that the drive rod 32 is depicted in FIG. 4 as being farther to the right (from the perspective of FIGS. 1-2 and 4-6C) with respect to the vacuum interrupter 16 than in FIG. 1.

The wear indicator 4 is depicted in FIGS. 1-3 as including a pair of elongated legs 84A and 84B that are mounted on the pin 76 adjacent the first and second plates 82 and 86, respectively, and as further including an elongated indication element 88 that is mounted to the legs 84A and 84B. The indication element 88 is situated at various positions with respect to the graduations 52 depending upon the amount of compressive loading of the compression spring 68 which, as will be set forth in greater detail below, is indicative of the wear on the contact 24 and 28.

Figures 4, 6B:
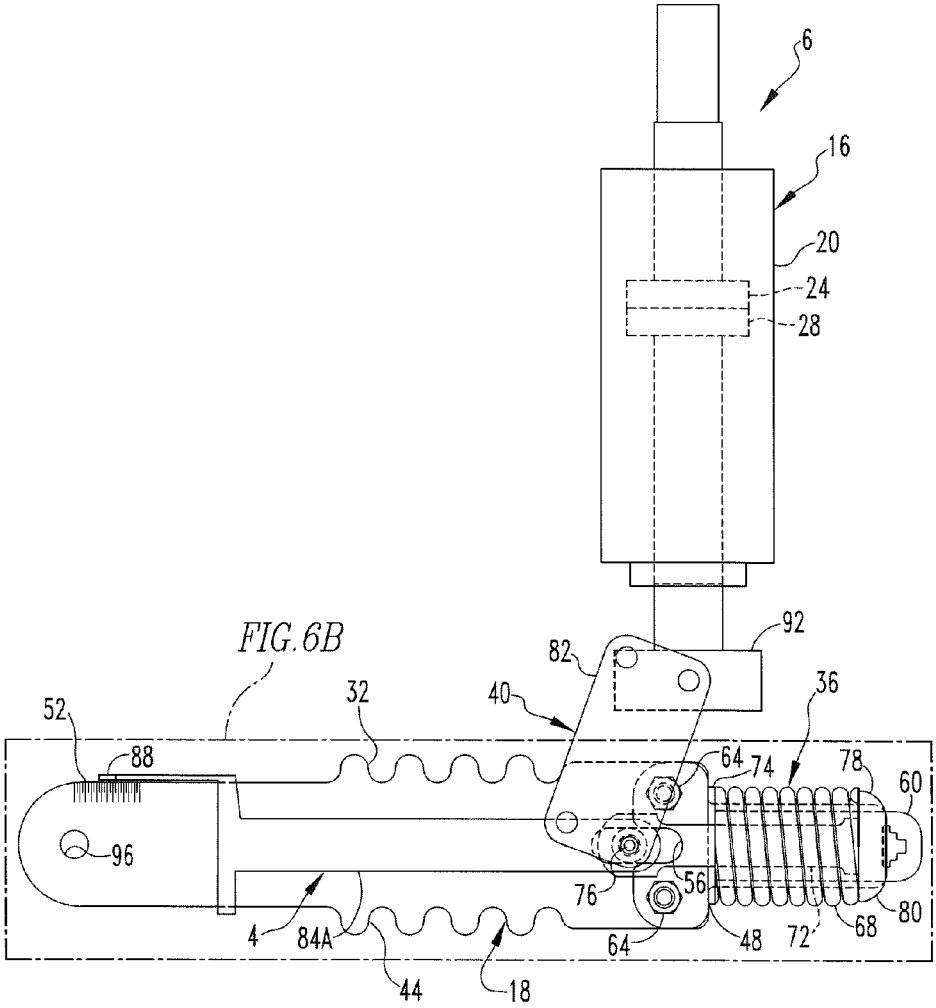
FIG. 4 is a side elevational view of the electrical interruption apparatus of FIG. 1, except with the set of electrical contacts being in a CLOSED position and having zero wear.
FIG. 6B is an enlarged depiction of the indicated portion of FIG. 4.
Figure 6A:
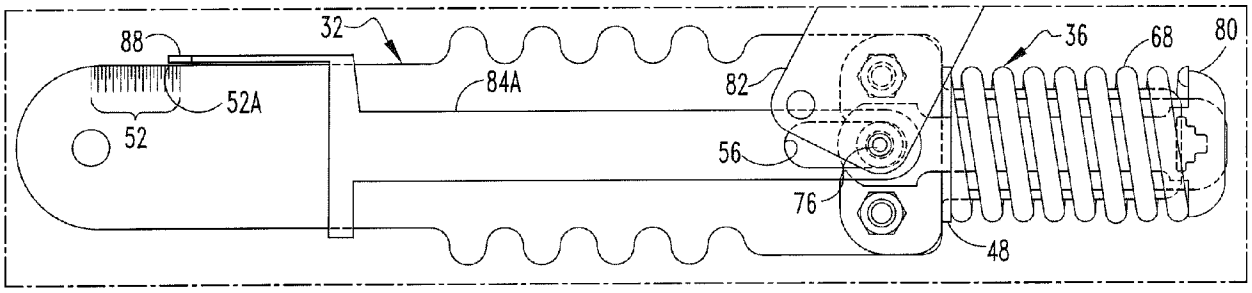
FIG. 6A is an enlarged depiction of the indicated portion of FIG. 1.
Figure 6B:
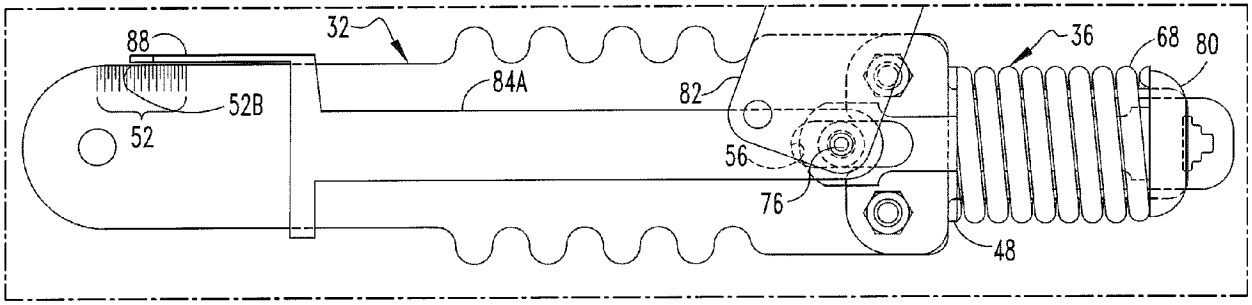

More particularly, FIGS. 1 and 6A depict the drive rod 32 when the fixed and movable contacts 24 and 28 are in their OPEN position wherein the only compressive loading on the compression spring 68 is the aforementioned preload that exists when the pin 76 is received against the rightmost end of the slot 56 (from the perspective of FIGS. 1 and 6A). In such a situation, the compression spring 68 is retained in the condition interposed between the flange 48 and the retainer 80. Also in such a situation, the indication element 88 is situated adjacent one of the graduations 52A that is generally at the right end of the set of graduations 52.

When the drive mechanism 18 has been moved from its OPEN position in FIG. 1 to its CLOSED position in FIG. 4, however, the bellcrank 40 has moved the movable contact 28 from its OPEN position to its CLOSED position during a first part of the stroke of the drive rod 32. During the remainder of the stroke of the drive rod 32 (i.e. between the point of initial engagement between the fixed and movable contacts 24 and 28 and the CLOSED position of the drive rod 32), the drive rod 32 loads the compression spring 68 in compression since the bellcrank 40 is held in place by the engagement of the movable contact 28 with the fixed contact 24.

When the fixed and movable contacts 24 and 28 are in a zero wear condition, such as is depicted generally in FIG. 4, the compression spring 68 experiences its greatest degree of compression, and this can be visualized by the pin 76 in FIGS. 1 and 6A having moved along the slot 56 in a leftward direction beyond the midpoint of the slot 56. In such a situation, and as is depicted generally in FIGS. 4 and 6B, the indication element 88 has moved with respect to the set of graduations 52 to be adjacent a graduation 52B that is to the left of the midpoint of the set of graduations 52. A technician could observe the particular graduation 52B that is adjacent the indication element 88 in the zero wear condition of FIGS. 4 and 6B and may either make note of the location of the particular graduation 52 or may take some other action to record or otherwise note the location of the indication element 88 with respect to the set of graduations 52.

Figure 5:
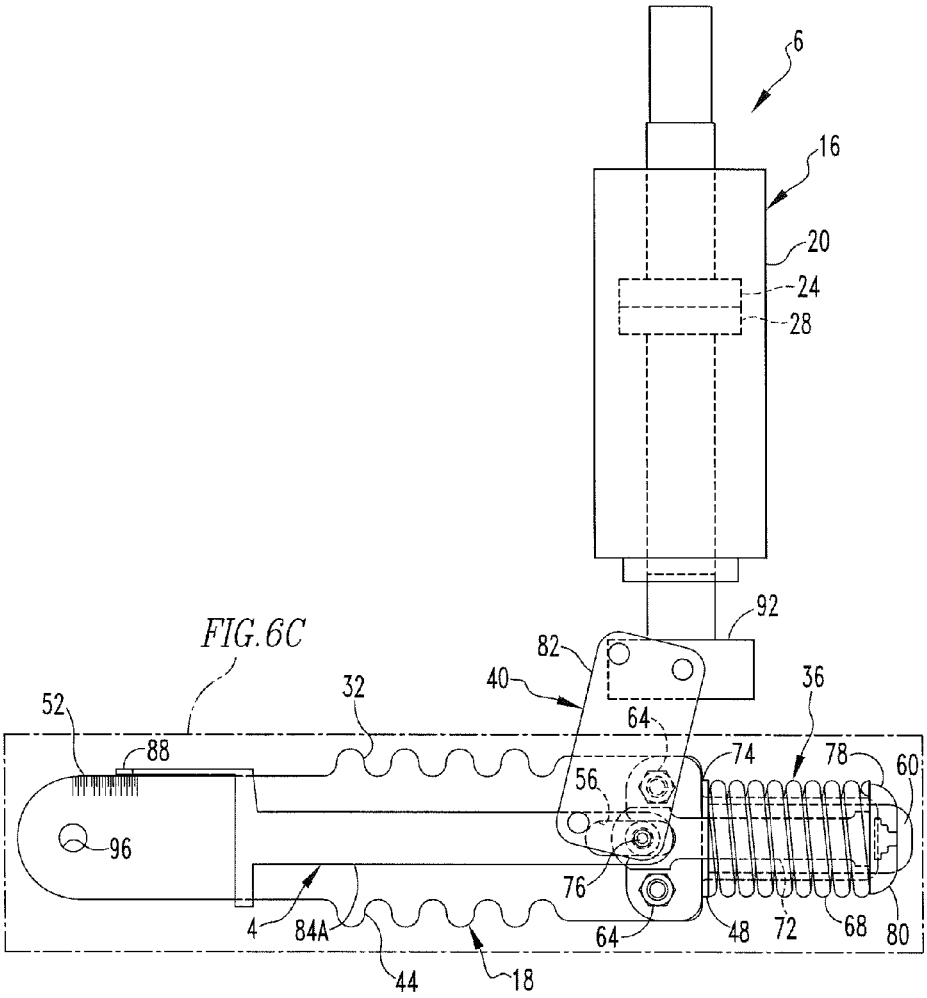
FIG. 5 is a view similar to FIG. 4, except depicting the electrical interruption apparatus in the CLOSED position with the set of separable contacts being in a high wear condition.
Figure 6C:
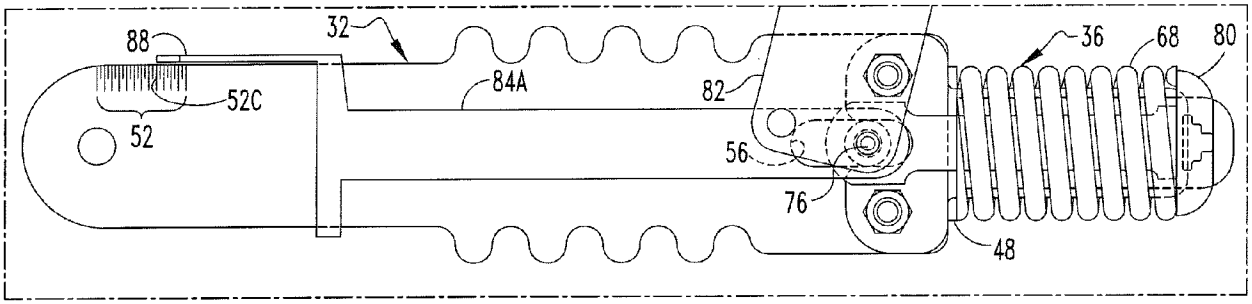
FIG. 6C is an enlarged depiction of the indicated portion of FIG. 5.

As the fixed and movable contacts 24 and 28 experience wear over time, however, the compression spring 68 is loaded with a lower level of compressive force since the bellcrank 40 must pivot relatively farther than in FIGS. 4 and 6B to cause the fixed and movable contacts 24 and 28 to become mechanically and electrically engaged with one another. For example, when the drive mechanism 18 is moved from its OPEN position (as is depicted generally in FIG. 1) to its CLOSED position (as is depicted in FIG. 5) in the high wear situation, the bellcrank 40 moves the movable contact 28 into engagement with the fixed contact 24 during a first part of the stroke of the drive rod 32, and the compression spring 68 is loaded in compression during a second portion of the stroke of the drive rod 32. However, since the fixed and movable contacts 24 and 28 having experienced wear, the first portion of the stroke is relatively greater than was the case in the zero wear situation (as in FIG. 4). Likewise, the portion of the stroke that compresses the compression spring 68 is relatively less, i.e., shorter, than was the case in the zero wear situation of FIG. 4. This is illustrated by comparison of FIGS. 6B and 6C which demonstrate that the compression spring 68 in the high wear situation of FIG. 6C is at a lesser state of compression than it is in the zero wear situation of FIG. 6B. Furthermore, the pin 76 can be seen as being farther to the right (from the perspective of FIGS. 6A-6C) within the slot 56 in the high wear situation of FIG. 6C then when in the zero wear situation of FIG. 6B. Correspondingly, the indication element 88 can be seen in FIG. 6C as being situated adjacent a graduation 52C that is rightward of the graduation 52B that was indicative of the zero wear situation of FIG. 6B. Advantageously, the technician can again observe the position of the indication element 88 adjacent the graduation 52C and can note the relationship therebetween and may determine therefrom that the wear on the fixed and movable contacts 24 and 28 is near or past a pre-established wear limit that would indicate the need for maintenance or other attention on the vacuum interrupter 16.

Furthermore, the technician can be aware of the various locations of the indication element 88, i.e., adjacent the graduations 52A, 52B, 52C, by way of example, when the drive rod 32 is in its leftmost and/or rightmost positions. If the indication element 88 is seem to have suddenly become moved from its anticipated location, this can signal the need for other attention being required for other portions of the circuit interruption apparatus 6.

It thus can be seen that the elongated legs 84A and 84B are connected directly with the over-travel mechanism 36, particularly the responsive portion 78, and communicate the degree of compressive loading on the compression spring 68 to a location on the drive rod 32, which is connected with the driven portion 74 of the over-travel mechanism 36. This location is at the end of the shank 44 adjacent one of the graduations 52 of the set of graduations 52, which is a location that can easily be observed by a technician. The ease with which the degree of wear on the fixed and movable contacts 24 and 28 can be ascertained by the technician thus saves time and effort and provides for better maintenance of the circuit interruption apparatus 6.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrical interruption apparatus comprising:

a set of separable contacts comprising a stationary contact and a movable contact;

a drive rod that is elongated and that comprises a first end and a second end opposite one another, the drive rod further comprising a reference situated at the first end, the drive rod being movable between an OPEN position wherein the stationary and movable contacts are separated from one another and a CLOSED position wherein the stationary and movable contacts are engaged with one another;

a biasing apparatus having a driven portion that is connected with the drive rod at its second end and further having a responsive portion that is connected with the movable contact, the biasing apparatus being movable between a first state when the drive rod is in the OPEN position and a second state wherein the drive rod is in the CLOSED position and the movable contact is biased by the biasing apparatus against the stationary contact, at least one of the driven portion and the responsive portion being movable with respect to the other of the driven portion and the responsive portion in moving between the first and second states to apply an amount of loading to the biasing apparatus; and an indication apparatus comprising an indication element that is connected with the responsive portion and that is structured to provide at the reference an indication that is representative of the amount of loading, the indication being a relative position of the indication element with respect to the reference.

2. The electrical interruption apparatus of claim 1 wherein the indication apparatus comprises a support that is elongated and that is connected with the responsive portion, the indication element being situated at an end of the support opposite its connection with the responsive portion.

3. The electrical interruption apparatus of claim 2 wherein the indication element is situated adjacent at least a portion of the drive rod when the drive rod is in the CLOSED position.

4. The electrical interruption apparatus of claim 3 wherein the indication is the relative position of the indication element with respect to the reference when the drive rod is in the CLOSED position.

5. The electrical interruption apparatus of claim 2 wherein the support comprises a pair of legs situated at alternate sides of the drive rod, the indication element being situated on the pair of legs.

6. The electrical interruption apparatus of claim 1 wherein a change in the indication over time is indicative of wear of at least one of the stationary contact and the movable contact.

7. The electrical interruption apparatus of claim 1 wherein the set of stationary contacts further comprises a vacuum interrupter bottle, the stationary and movable contacts being situated within an evacuated interior of the vacuum interrupter bottle.

8. The electrical interruption apparatus of claim 1 wherein a variation in the indication over time is representative of a reduction in spring loading of the biasing apparatus.

9. The electrical interruption apparatus of claim 1 wherein the reference is situated on the drive rod at a location on the drive rod that is generally opposite another location on the drive rod at which the drive rod and the biasing apparatus are connected together.

10. The electrical interruption apparatus of claim 1 wherein at least one of the reference and the indication element comprises a plurality of graduations that are spaced apart from one another.

11. The electrical interruption apparatus of claim 10 wherein the plurality of graduations are situated on the drive rod.

* * * * *